US006242851B1

(12) United States Patent
Zhu et al.

(10) Patent No.: US 6,242,851 B1
(45) Date of Patent: Jun. 5, 2001

(54) DIMMABLE METAL HALIDE LAMP WITHOUT COLOR TEMPERATURE CHANGE

(75) Inventors: Huiling Zhu, Lexington; Jakob Maya, Brookline, both of MA (US)

(73) Assignee: Matsushita Electric Works Research and Development Laboratory Inc, Woburn, MA (US)

( * ) Notice: Subject to any disclaimer, the term of this patent is extended or adjusted under 35 U.S.C. 154(b) by 0 days.

(21) Appl. No.: 09/074,623

(22) Filed: May 7, 1998

(51) Int. Cl.[7] ..... H01J 1/02; H01J 7/24; H01J 61/52; H01J 17/16; H01K 1/58

(52) U.S. Cl. ..... 313/25; 313/17; 313/27; 313/47; 313/493; 313/634; 313/635

(58) Field of Search ..... 313/13, 17, 25–26, 313/27, 47, 634–35, 493, 492, 624–626, 637–38, 642–43; 250/227

(56) References Cited

U.S. PATENT DOCUMENTS 3,723,784 * 3/1973 Sulcs et al. ..... 313/47
4,074,163 * 2/1978 Van Der Leeuw ..... 313/27 X
4,230,964 * 10/1980 Bhalla ..... 313/638
4,245,155 * 1/1981 Witting ..... 250/227
4,401,912 * 8/1983 Martzloff et al. ..... 313/17
5,162,693 * 11/1992 Van Der Leeuw et al. ..... 313/27

OTHER PUBLICATIONS

R. G. Gibson; "Dimming of Metal Halide Lamps"; Journal of IES; Summer, 1994.

* cited by examiner

*Primary Examiner*—Nimeshkumar D. Patel
*Assistant Examiner*—Mack Haynes

(57) ABSTRACT

This invention relates to dimmable metal halide lamps using ceramic arc tubes for the application of energy saving, mood control, and constant light output over the life of the lamp. Under dimmed conditions, as low as 50% of rated wattage, the color temperature (CCT) can remain substantially the same and be perceived by the viewer as a constant color light source. Furthermore, the invention improves the color rendering index (CRI) and the efficacy of the lamp under dimmed operation. Such improvements are provided by placing a metal shield on an end of the arc tube, whereby the emissivity of the shield is lower than the emissivity of the ceramic in the arc tube, whereby cold spot temperature in the lamp is increased, even under dimmed conditions.

12 Claims, 6 Drawing Sheets

DIMMABLE METAL HALIDE LAMP WITHOUT COLOR TEMPERATURE CHANGE

FIELD OF THE INVENTION

The present invention relates to dimmable high pressure arc discharge lamps emitting primary white light for general illumination.

BACKGROUND OF THE INVENTION

Metal halide lamps have been commercially available for about 30 years. Since then, overall lamp performance has been continuously improving. Such improvements include increasing the efficiency and the life of the lamps. Utilization of various materials, including rare earth halides, have yielded substantially higher color rendering index (CRI) at various correlated color temperatures (CCT). More recently, metal halide lamps, with ceramic arc tubes of polycrystalline alumina and compatible special frit materials, have dramatically improved the color consistency of such lamps. The ceramic arc tubes enable metal halide lamps to operate with a much smaller color spread. Also, lamp-to-lamp color variation has been reduced dramatically. Over the last several years, the need to save energy has become more acute due to global warming issues and, as a result, many researchers have been investigating ways of reducing the energy consumption of lighting. Dimming the lamps, of course, generally allows saving energy when full light output is not necessary. In industrial and commercial establishments the dimmed period could be between store closing hours such as 8:00 p.m. or 11:00 p.m. In outdoor applications it could be between 11:00 p.m. and 6:00 a.m. However, when existing metal halide lamps are dimmed, the metal halide vapor pressure in the arc tubes drops dramatically resulting primarily in a mercury discharge in which the CCT of the dimmed metal halide lamp is much higher than the CCT of the lamp when it is operating at rated wattage.

This change of CCT is disturbing and very perceptible to the viewer. R. G. Gibson, "Dimming of Metal Halide Lamps," Journal of IES, Summer 1994, has investigated the issue in lamps which utilize phosphor-coated outer jackets. The phosphor is typically europium-activated yttrium vanadate which responds to the 365 nm emission line of mercury. As a result, when the lamp is dimmed, the mercury UV radiation is converted into more reddish emission from the phosphor coating which results in a relatively small color change. However, this is only for coated lamps and the effects are limited. Clear lamps do not have the advantage of being able to convert mercury radiation into more reddish visible radiation. Coated lamps are more expensive to manufacture and have more limited applications. Therefore, it is highly desirable to have dimmable clear jacket lamps without substantial CCT change under dimming.

In addition to saving energy in high bay and outdoor applications or industrial and commercial installations by turning down the light source, there are also applications in mood control, especially at the lower power levels (e.g., 150 W or lower). This could be in applications where metal halide lamps are used primarily indoors, such as restaurants, residential and semi-commercial installations or entertainment establishments, where color has to be maintained under continuous dimming.

A further application for dimmable metal halide lamps is where one wants to maintain constant light output throughout the life of the lamps. As is well known, under normal circumstances, where the lamp is operated at rated power over its life, there will be some light output depreciation which can be as much as 40–50% depending on the maintenance, chemistry and power level of the lamp. In some applications this is quite objectionable and the environment is not well served by that kind of light output depreciation. Therefore, compensation could be produced by either overdriving the lamp (which shortens the life considerably) or starting from a 20–30% reduced power state, so as luminosity decreases, lamp power increases automatically to produce a constant light output through the life of the lamp. This can be done with electronic power controls and sensors.

When commercially available metal halide lamps are dimmed, typically the color temperature increases from 500° K to about 1500° K, depending on the lamp chemistry. Furthermore, one of the dramatic changes that takes place (especially for rare earth chemistries) is the hue of the light source changes from white to somewhat greenish. Such lamps contain (in addition to rare earth halides) thallium iodide and sodium iodide to improve the efficacy. The vapor pressures of the rare earth halides are substantially different than thallium iodide at different temperatures. Thallium iodide typically is unsaturated and has a higher vapor pressure than the vapor pressures of the rare earth halides. When the lamps are dimmed 30 or 50% in power, the cold spot temperature drops. The less volatile rare earth halide vapor pressure drops dramatically, whereas the thallium iodide remains in the gas phase and gives a greenish hue to the lamps. When thallium iodide is removed so only rare earth halides remain, the efficiency is not as high as it could be, or has been shown to be possible, under full rating of the lamps.

OBJECTS OF THE INVENTION

Therefore, an object of the present invention is to provide a metal halide light source which is dimmable for energy saving applications.

Another object is to have a metal halide light source which is dimmable down to about 50% power level, while maintaining high efficiency and minimum color temperature change.

A further object is to provide a light source with high CRI under both dimmed and rated power conditions.

Another object is to provide a metal halide light source which has continuous dimming possibilities and minimum color temperature change which would not be perceptible to the eye.

A further object of the invention is to provide a metal halide light source that is dimmable for all the different CCTs (3000, 4100, 4500, 5000° K, etc.) and all power levels (35 W to 400 W and above).

Another object of the invention is to provide a metal halide light source that is dimmable for all the different chemistries.

A further object of the present invention is to provide a dimmable light source that is compatible with high and low frequency electronic ballast operation, as well as magnetic ballast operation.

Still another object is to provide a dimmable metal halide light source with a clear outer jacket that substantially maintains its color temperature (CCT) when dimmed.

SUMMARY OF THE INVENTION

According to the present invention, a metal halide lamp can be dimmed to about 50% power while maintaining the color substantially the same as it is at rated power, while maintaining a high efficacy and CRI during the dimming as well as rated power conditions. The invention is applicable to a whole variety of metal halide lamps at different power levels, as well as different chemistries.

We have discovered one of the most effective ways of maintaining metal halide lamp performance under dim, as well as rated conditions, is to improve the thermal environment within the arc tube. That is, we have discovered if ingredients of the lamp chemistry are prevented from condensing when dimming the lamp, then the overall performance of the lamp can be maintained. In order to do that we had to increase, somewhat, the cold spot temperature under rated conditions in such a manner that under dimmed conditions we have just a very small change in cold spot temperature.

According to the present invention, we provide at least one metal heat shield on the outside of a ceramic arc tube, near the electrode areas, so as little light output as possible is blocked, but yet provide a higher cold spot temperature under dimmed conditions. This is primarily accomplished as a result of the characteristics of the metal and its emissivity relative to the emissivity of ceramic materials. The metals suitable for the heat shield materials have lower emissivity at lower temperatures. For the entire temperature range of the cold spot during a dimming operation, the metals have lower emissivity than aluminum oxide or zirconium oxide, the conventional coating materials on the ends of arc tubes. The lower the cold spot temperature, the larger the emissivity difference between metals and ceramics. A metal heat shield covering the cold spot area will increase the cold spot temperature at rated power and will significantly reduce the temperature drop during dimmed operation. We found the emissivity of the metals used increases with increasing temperatures which is opposite to that of ceramics, such as polycrystalline alumina. Substantial improvement is offered because, as the temperature is reduced at dim conditions, the lower emissivity of the metals maintain the cold spot temperature better and prevents it from going lower. At the higher temperature, due to the higher emissivity, the shield prevents the cold spot from becoming too hot. So, in some sense, the shield corrects the emissivity trend of the ceramic and makes the arc tube more constant as a function of applied power.

Ideally, the goal is to have essentially the same cold spot temperature under rated as well as lower power dim conditions. This is accomplished with a variety of metals, and the optimization of the lamp depends on the operating position and the power level, as well as the particular chemistry of the arc tube. We have found the color temperature can be contained within several hundred degrees for an approximate 50% power level reduction. The CRI, in many cases, is either maintained the same or improved compared to existing lamps. The efficacy often is improved as the lamp is somewhat dimmed simply because, at rated power, the cold spot temperature is running somewhat hotter than the optimum.

We would like to note our objectives could not be obtained either by making the arc tube smaller or increasing the wall loading ($W/cm^2$). Either of these approaches does not have the selective heat loss (or the emissivity) feature mentioned above. Therefore, in both cases, the CCT changes substantially when the lamp is dimmed. Furthermore, we should note either of these approaches may have adverse consequences in maintenance and life of the lamp due to the increased rate of high-temperature chemical reactions between the lamp fill and arc tube materials.

DETAILED DESCRIPTION OF THE INVENTION

Figure 1:
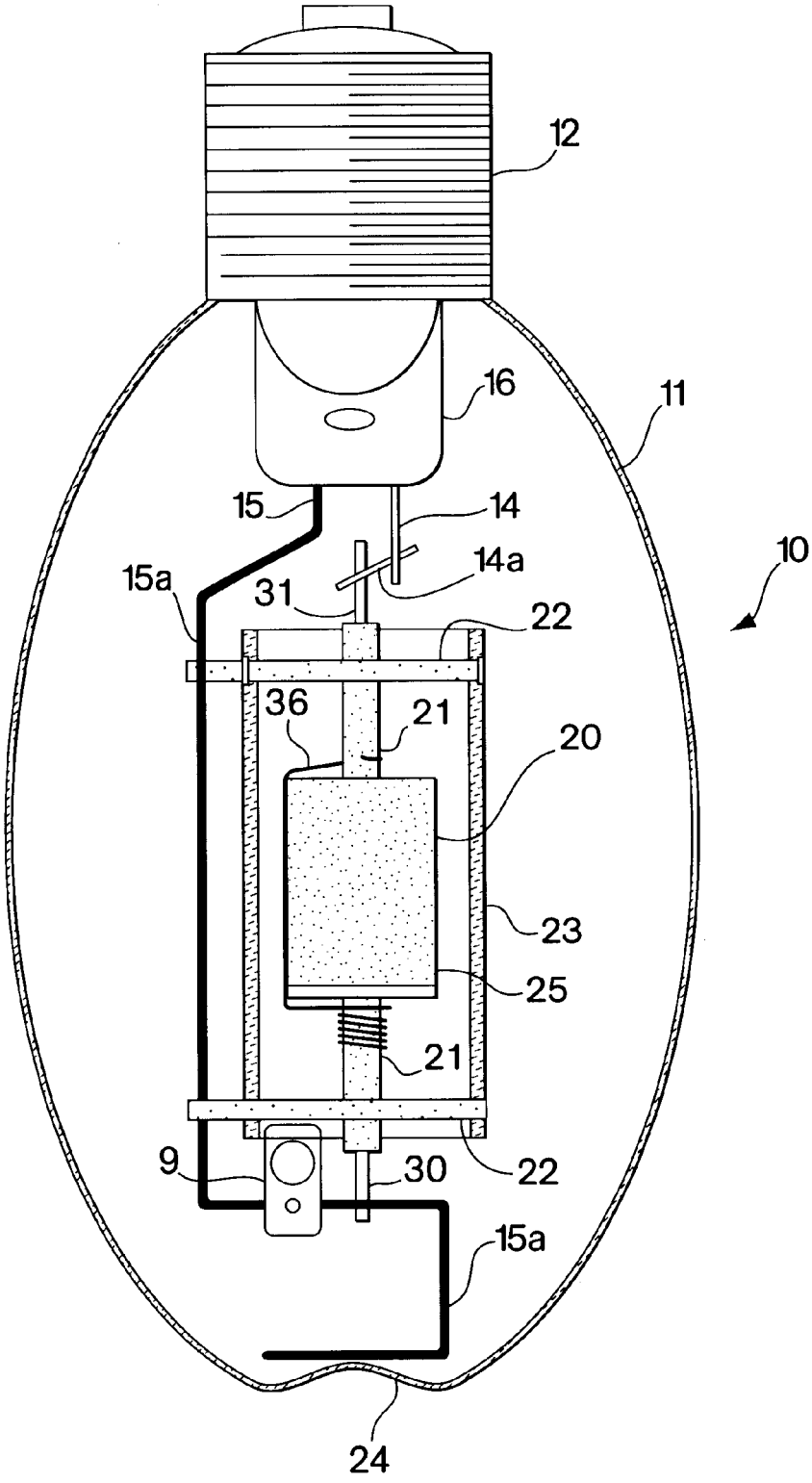
FIG. 1 is an elevational view, partially in cross section, of a ceramic arc tube in a metal halide lamp wherein a metal heat shield is held in place by a length of wire on the outside the ceramic arc tube.

Referring to FIG. 1, the lamp 10 of the present invention includes a bulbous envelope 11 having a conventional base 12 fitted with a standard glass flare 16. Lead-in wires 14 and 15 extend from the base 12 through the flare 16 to the interior of the envelope 11, as is conventional. A harness formed of a bent wire construction 15, 15*a* is disposed within the envelope 11. The harness is anchored within the envelope on dimple 24. An arc tube 20 is supported by the harness 15, 15*a*. A pair of straps 22 which are attached to harness 15*a* hold a shroud 23 which surrounds the arc tube 20. A conventional getter 9 is attached to the harness 15*a*. Wires 30, 31 supporting electrodes (not shown) are respectively attached to harness 15*a* and lead-in wire 14*a* to provide power to the lamp and also provide support. Wires 30, 31 are disposed within and hermetically sealed to tubes 21. The metal shield 25 of the present invention is disposed against the bottom of the arc tube 20, as will be described hereinafter. The shield 25 can be supported in position by starting wire 36. The ends of wire 36 can be wrapped around tubes 21. A wire of this nature need not be used to keep the metal shield in place. Many other mechanical ways, such as crimping or tight fitting, etc., could be imagined by those skilled in the art.

Figure 2D:
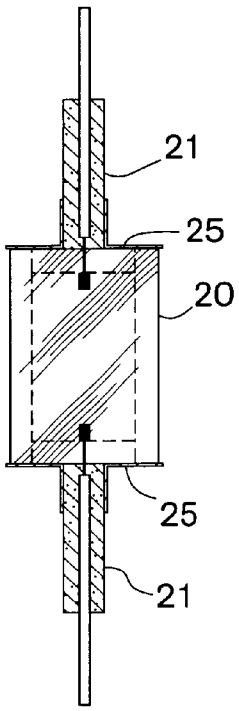
FIGS. 2*a* to 2*d* are elevational views, partially in cross section, of several embodiments of the present invention.
Figure 2C:
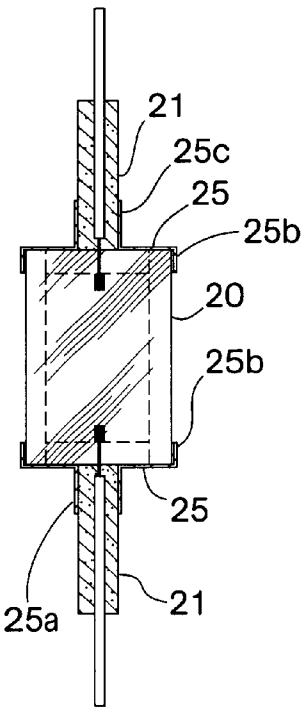
Figure 2B:
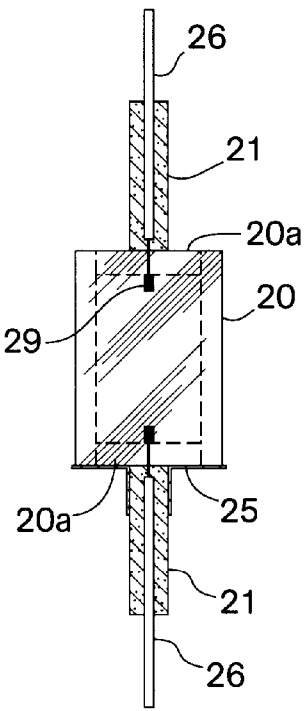
Figure 2A:
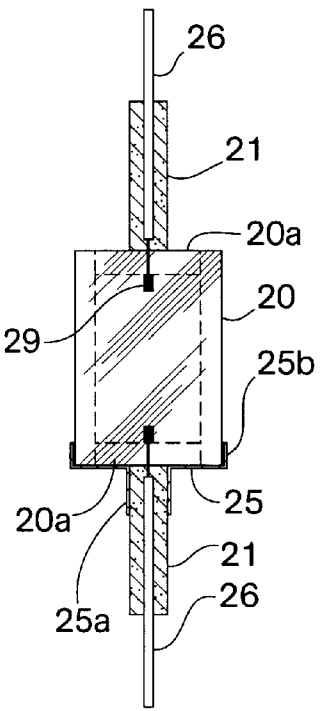

Referring now to FIGS. 2*a* to 2*d*, four embodiments of the present invention are shown. In FIGS. 2*a* and 2*b* the heat shield 25 is shown on only one end of the arc tube 20. In FIGS. 2*c* and 2*d*, the heat shield 25 is shown disposed on both ends of the arc tube 20.

In FIGS. 2*a* and 2*d*, the arc tube 20 (formed of polycrystalline alumina) is a generally cylindrical tube having end caps 20*a* disposed therein. As is conventional, end caps 20*a* are fitted and sealed by conventional frit-sealing techniques within the arc tube 20. Tubes 21 are attached to end caps 20*a*. A lead-in wire 30 and 31 is disposed within each tube 21 and is frit sealed to the interior thereof. An electrode 29 is disposed at the distant end of each of the lead-in wires 30 and 31, as is conventional.

A metal heat shield 25, according to the present invention, is disposed over end cap 20*a* for the purposes discussed above. A first skirt 25*a* extends around the tube 21 and a second skirt 25*b* extends around arc tube 20. FIG. 2*b* differs from FIG. 2*a* in that the heat shield shown in FIG. 2*b* does not have the skirt 25*b* around arc tube 20. Thus, the ends of the arc tube 20 can either be fully or partially covered by the heat shields as shown in FIG. 2*a* and 2*b*. The length of skirt 25*b* can be between about 0.5 and 3 mm with approximately 1 mm being preferred. The length of the skirt 25*a* covering the tube 21 is preferably between about 1 and 8 mm, 3 mm being most preferred. It is important to note that shields 25 are electrically floating. Unless the shields were electrically floating, they would provide a bias on the shield which would draw sodium in the fill to the outside of the arc tube, thereby contributing to poor maintenance due to darkening of the arc tube. The heat shield material can be a metal such as molybdenum, nickel, niobium, and Kovar that can work under relatively high temperatures. The heat shield can be kept in place by a molybdenum or a tungsten starting wire holding both ends of an arc tube. While the fabrication of a metal shield having the above-described characteristics is preferred, the shield can also be plated on the arc tube.

In FIGS. 2*c* and 2*d*, both ends of the arc tube 20 are covered end caps 25. Again, FIG. 2*d* differs from FIG. 2*c* in that skirt 25*b* is disposed around the ends of the arc tube. Placing the skirt 25 over both ends can enable the user to operate the lamp both base up and base down.

Figure 3A:
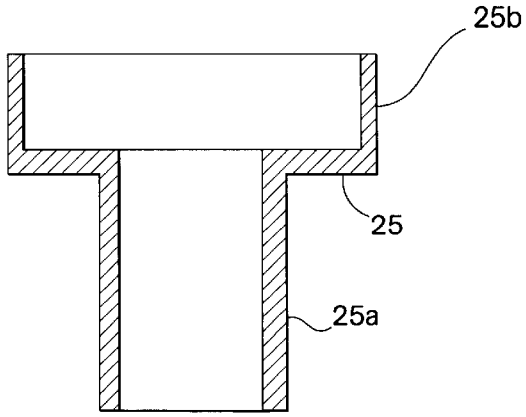
FIGS. 3*a*, 3*b* and 3*c*, 3*d* are different embodiments of the metal heat shield according to the present invention. In the 3*a*, 3*b* embodiment a complete shield is shown around the electrode-containing tube at the bottom of the ceramic arc tube. In the 3*c*, 3*d* embodiment, the shield has slotted openings to let more light emerge, thereby increasing the efficacy of the lamp.
Figure 3C:
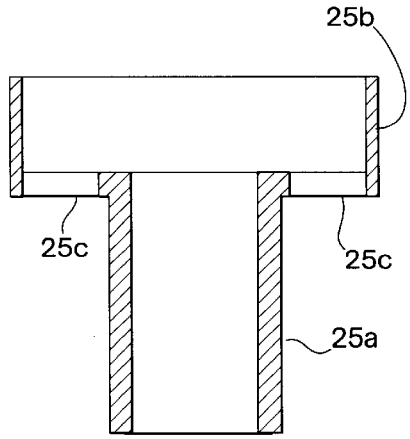
Figure 3B:
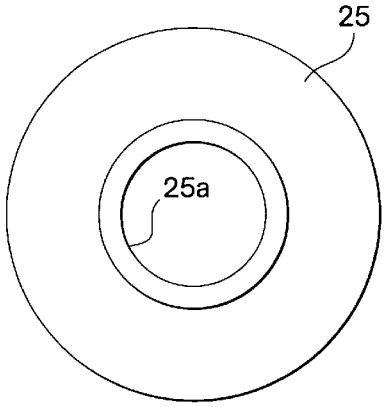
Figure 3D:
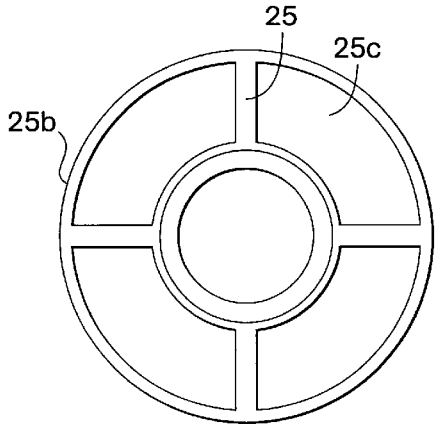

Referring now to FIGS. 3*a*, 3*b*, the heat shields of the present invention are shown in FIG. 3*a*. The heat shield 25 has skirt 25*a* extending so as to cover a portion of the tube which holds the lead-in wires to the electrodes. In the FIG. 3*c*, 3*d* embodiment, openings 25*c* are formed in heat shield 25, whereby the temperature of the cold spot within the arc tube can be varied due to the reflection of heat from the heat shield.

Figure 4:
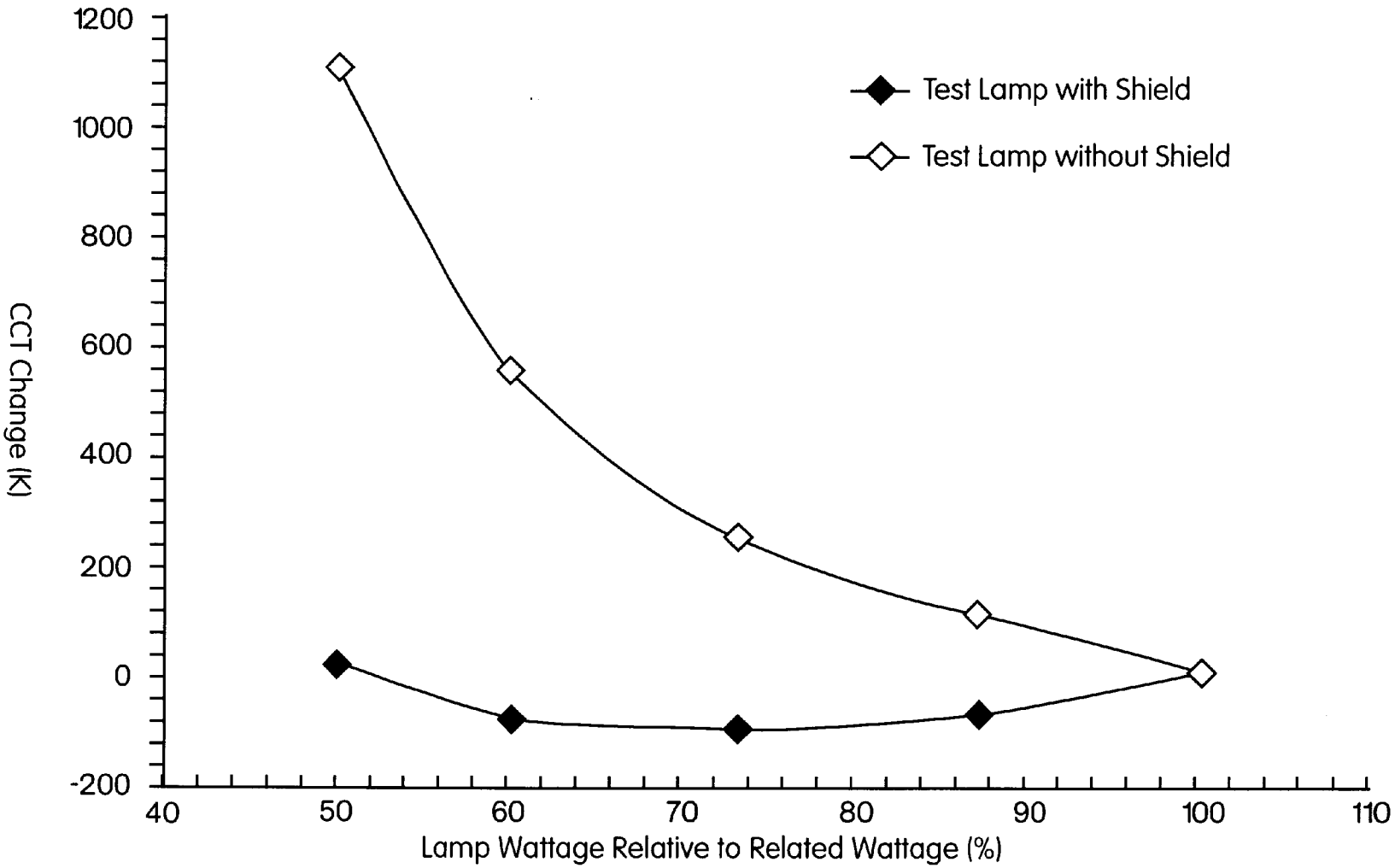
FIG. 4 are curves showing the CCT change in Kelvin as a percentage of rated wattage for lamps both with and without shields. As can be seen, lamps with the shield show a dramatic improvement in terms of reducing the CCT change as the lamp power is reduced from 100% to about 50%.
Figure 5:
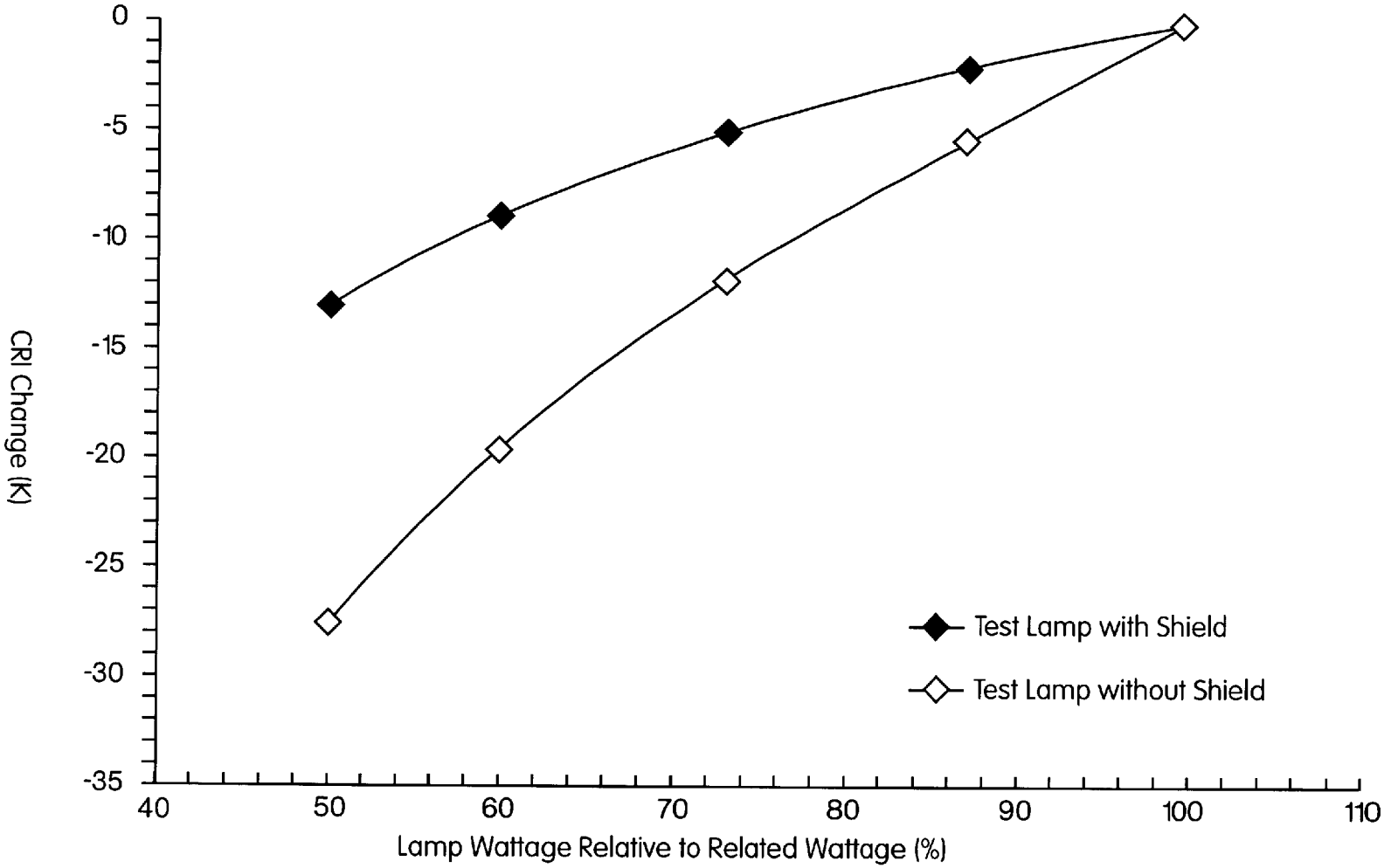
FIG. 5 are curves showing the CRI change in the dimming of metal halide lamps. As can be seen, the shields improved the change of CRI such that there is much less of a decline in the CRI when the lamp is dimmed.
Figure 6:
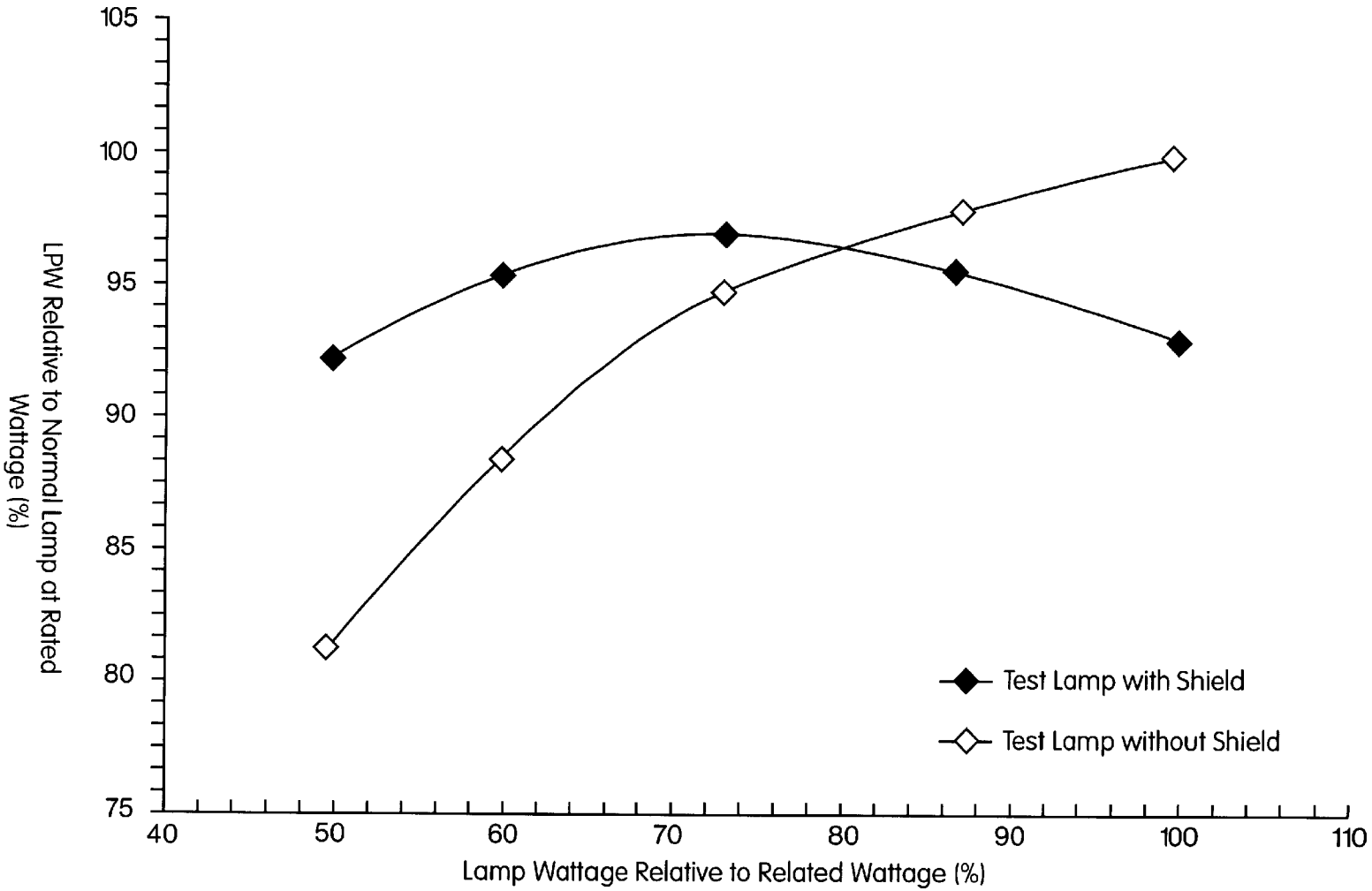
FIG. 6 are curves showing the change in LPW relative to a lamp at rated wattage. In this case, as can be seen, while the shield decreases the LPW by about 5–7% at 100% wattage, the luminosity increases (in LPW) as the lamp is dimmed. If the lamp stays in the dim mode 50–70% of the time, the average LPW is higher than a regular lamp working under the same dimming schedule.

Referring now to FIGS. 4 to 6, the lamps were operated with a reference ballast in a two meter integrating sphere under IES accepted conditions. These data were acquired with a CCD-based computerized data acquisition system. All data presented in FIGS. 4 to 6 were obtained with the operating position of the lamp being vertical base up. Both the controls and shielded lamps, according to the present invention, had that configuration. Since the cold spots tend to be at the bottom part of the arc tube, shields were not placed on both ends of the arc tube for testing purposes because one shield was sufficient. The experiments, for which the data is presented in FIGS. 4 to 6, were conducted using 150 W ceramic metal halide arc tube. The ceramic metal halide arc tube was filled with a conventional rare earth halide composition and it was enclosed in a quartz shroud and an ED17 outer jacket with an Edison base. The data in FIGS. 4–6 is for heat shields which were not slotted, but rather were a full piece of metal. The length of the heat shield covering the side wall of the ceramic arc tube is about 1 mm. The length of the heat shield covering the lead-in wire containing tube is about 3 mm in length.

During operation of the lamps according to the present invention, and when comparing them to standard lamps without heat shields, we found the standard lamps turned somewhat greenish on dimming and deviated substantially from the black body locus upon dimming to about 50%. When lamps with heat shields were dimmed to about 50%, they still remained substantially on the black body locus, had no greenish hue, and generally looked white. Such color was satisfactory to the eye and it was substantially impossible to discern any color or hue change under dimmed conditions.

Referring to FIG. 4, it can be seen that when a lamp with a heat shield was reduced to 50% of its relative lamp wattage, no significant change of color temperature occurred. With lamps without the heat shield, the color change was significant.

Referring to FIG. 5, the range in CRI for lamp wattage relative to rated wattage is shown. It can be seen the CRI decreased about 29% when testing lamps without the shield, whereas the CRI changed only about 13% with the shields. In each case, the decrease in the CRI occurred as the wattages of the lamps were reduced from 100 to 50 watts.

Referring to FIG. 6, it can be seen that the luminosity of the lamp significantly decreased when operating without a heat shield, as the lamp wattage was reduced relative to the rated wattage.

Arc tube temperature measurements were conducted to examine the effect of the metal shield on the cold spot temperature under rated and dimmed conditions. Cold spot temperature measurement data of two sample arc tubes, at different wattages, with and without metal heat shields, are summarized in the following Table.

| % of Rated Wattage | 100 | 80 | 60 | 40 |
|---|---|---|---|---|
| ΔT No Shield (° C.) | 0 | −61 | −133 | −226 |
| ΔT With Shield (° C.) | 0 | −43 | −93 | −150 |

Based on the measurement data, the metal shield used in this invention is effective for raising the cold spot temperature of an arc tube and is especially effective at minimizing the cold spot temperature drop during dimmed operation.

It is apparent that modifications can be made within the scope of the present invention, but it is our intention only to be limited by the appended claims.

As our invention we claim:

1. A high-pressure metal halide lamp that can be dimmed to about 50% power level or less such that the correlated color temperature is changed only minimally, well below the perception level of the human eye, said lamp comprising:

a ceramic arc tube, said arc tube being filled with a starting gas and at least one metal halide and may further contain mercury, said arc tube having end caps sealed into each end thereof and a tube extending outwardly from each of said end caps and a lead-in wire with an electrode disposed in each of said tubes, said electrodes being disposed in said arc tube; and a metal shield on at least one of said end caps, the emissivity of said shield being lower than the emissivity of said ceramic arc tube, whereby to reduce radiation heat loss from said arc tube and increase the cold spot temperature when operating at wattages less than rated wattages during dimming periods in the operation of said lamp.

2. The lamp according to claim 1 wherein said shield also surrounds a portion of said outwardly extending tube as a first skirt.

3. The lamp according to claim 2 wherein said first skirt covers about 1 mm to 8 mm of said arc tube.

4. The lamp according to claim 1 wherein said shield also covers a portion of said arc tube as a second skirt.

5. The lamp according to claim 4 wherein said second skirt covers about 0.5 mm to 3 mm of said arc tube.

6. The lamp according to claim 1 wherein said metal is a member selected from the group consisting of nickel, Kovar, niobium, molybdenum, and said arc tube is formed of polycrystalline alumina.

7. The lamp according to claim 1 wherein the metal shield is a metallic coating.

8. A high-pressure metal halide lamp that can be dimmed to about 50% power level or less such that the correlated color temperature is changed only minimally, well below the perception level of the human eye, said lamp being filled with a starting gas and rare earth halides or sodium, thallium and/or scandium iodides or a combination of metal halides and may further contain mercury, said lamp being designed for any rated power between 20 W and 1000 W, said lamp comprising:

a polycrystalline alumina arc tube, said arc tube having end caps sealed into each end thereof and a tube extending outwardly from each of said end caps and a lead-in wire with an electrode disposed in each of said tubes; and a metal shield on at least one of said end caps surrounding a portion of said outwardly extending tube as a first skirt, said metal being a member selected from the group consisting of nickel, Kovar, niobium, molybdenum, the emissivity of said metal shield and said polycrystalline alumina being inverse to each other as the arc tube temperature increases or decreases.

9. The lamp according to claim 8 wherein said first skirt covers about 1 mm to 8 mm of said outwardly extending tube.

10. The lamp according to claim 8 wherein said shield also covers a portion of said arc tube as a second skirt.

11. The lamp according to claim 10 wherein said second skirt covers about 0.5 mm to 3 mm of said arc tube.

12. The lamp according to claim 8 wherein the metal shield is a metallic coating.

* * * * *